US005698043A

United States Patent [19]

Acevedo

[11] Patent Number: 5,698,043

[45] Date of Patent: Dec. 16, 1997

[54] CLEANING ELECTRONICALLY CONTROLLED FLUID FUEL INJECTORS

[76] Inventor: Juan R. Acevedo, 78 Erlanger Blvd., N. Babylon, N.Y. 11703

[21] Appl. No.: 505,772

[22] Filed: Jul. 21, 1995

[51] Int. Cl.[6] ..... B08B 7/04

[52] U.S. Cl. ..... 134/10; 134/22.1; 134/22.12; 134/22.18; 134/169 A

[58] Field of Search ..... 134/10, 22.1, 22.12, 134/22.18, 24, 169 A, 169 C

[56] References Cited

U.S. PATENT DOCUMENTS

| | | | |
|---|---|---|---|
| 4,082,565 | 4/1978 | Sjolander | 134/1 |
| 4,520,773 | 6/1985 | Koslow | 123/198 A |
| 4,606,311 | 8/1986 | Reyes et al. | 123/198 A |
| 4,909,207 | 3/1990 | Takano et al. | 123/198 A |
| 4,920,996 | 5/1990 | Flanner | 134/22.11 |
| 5,503,683 | 4/1996 | Butcher et al. | 134/22.12 |

*Primary Examiner*—Robert J. Warden
*Assistant Examiner*—Saeed Chaudhry
*Attorney, Agent, or Firm*—Brooks Haidt Haffner & Delahunty

[57] ABSTRACT

An electronically controlled and operated injector for gaseous fuel is cleaned in situ of contaminant residues by passing isopropyl alcohol through the injector while directing electrical signals to solenoid fuel flow valves of the injector to open and close the valves in succession while the alcohol is flowing through the injector. Removal of the injector from a vehicle and disassembly of the injector are not required for cleaning of the injector.

10 Claims, 3 Drawing Sheets

CLEANING ELECTRONICALLY CONTROLLED FLUID FUEL INJECTORS

BACKGROUND OF THE INVENTION

1. Field of the Invention

The present invention relates to the cleaning of valves by passing a cleaning liquid therethrough, and more particularly to the cleaning of electronically operated and controlled gaseous fuel injectors such as the gaseous fuel injectors employed in compressed natural gas powered automotive engines.

2. Discussion of the Prior Art

The use of compressed natural gas (CNG) as an alternative or substitute for liquid petroleum gasoline as a fuel for conventional automotive engines has become increasingly common. CNG is employed to power both cars and trucks.

In order to provide a sufficient mass of CNG to run a vehicle engine, high flow injectors are used to deliver the CNG to the combustion chambers of vehicle engines. The high flow injectors must feed the proper amount of CNG fuel to the vehicle engine to meet the changing demands of the engine. Because of the large number of factors that must be taken into consideration to operate the injectors in response to changing fuel demands, computer control systems are employed to provide electrical operating signals to the injectors.

GFI Control Systems, Inc., of Kitchener Ontario, Canada, provides a computer controlled injector device for use in CNG powered automotive engines under the tradename or mark COMPUVALVE.

The Compuvalve injector, which contains the fuel metering valves and an inboard computer for controlling fuel delivery in response to engine operating conditions, can be considered as representative of computer controlled fuel injection devices for internal combustion engines.

In CNG powered engines, a high pressure regulator controls the pressure of gas from a supply such as a tank of compressed gas. At the regulator, the high pressure natural gas is first passed through a filter, for example, a 40 micron filter, thence through a high pressure solenoid valve to a high pressure transducer sensor which measures the gas pressure and sends electrical signals to a fuel gauge, which gives a gas pressure reading indicative of the quantity of gaseous fuel remaining in the CNG supply tank. The regulator includes conventional means for delivering natural gas at reduced pressure (say about 100 psig) to a regulator outlet. From the regulator outlet the CNG, at a reduced pressure, passes through a secondary filter and then goes through a conduit to the inlet of the injector, exemplified by the computer controlled Compuvalve injector, which regulates the fuel flow through a series of electronically controlled solenoid valves whence the fuel is passed to a discharge device located in the air intake of the engine.

The inboard computer of the Compuvalve injector can routinely control not only fuel flow, spark advance and the fuel supply signal to the fuel gauge but can also control fuel selection if the engine is operating in a dual-fuel environment using both liquid gasoline and CNG as alternative fuels (as is often the case when a gasoline powered engine is retrofitted for use with CNG). The input to the computer can be provided by a number of remote sensors that provide information relating to pressures and temperatures throughout the system.

The computer performs calculations, based on calibrations and input from the sensors, that result in computer commands that adjust fuel flow to the engine.

When the solenoid valves of the Compuvalve high flow injector are working normally, a CNG powered engine performs like a vehicle engine powered by liquid gasoline (subject to the qualification that since natural gas is less energy dense than gasoline, the maximum power that an engine operating on CNG can deliver is slightly lower than power delivered by the same engine operating on gasoline). However, since the computer controlled injector bears such complete responsibility for engine performance, degradation or failure of the computer controlled injector will disable the engine.

Operation of the solenoid valves can be impaired by the build up of contaminant deposits within the valves. Despite the fact that the CNG is quite clean, the presence of even a very small quantity of contaminants per unit volume of gas can be harmful, because of the large volume of gas that passes through the injector over an extended period of operation. Examination of contaminant deposits removed from dirty valves shows that oil taken up by the natural gas from compressors used in CNG fuel production and handling is a major source of contamination, although other particulate debris can also be present.

In the past, when a symptom, such as surging of a vehicle engine after the vehicle had been running smoothly, suggested deficient injector performance, the routine procedure was time consuming and expensive. After bleeding off system pressure and removing the fittings from the Compuvalve injector, the regulator valve and the filter, the insides of orifices of the fittings and the components would be checked for the presence of contaminant residues. If residue deposits were found, the fuel vessels and lines were emptied and cleaned, the fuel filter was replaced and the entire Compuvalve injector device was removed and sent to the manufacturer for factory cleaning. At the factory, the injector was disassembled and the numerous component parts were individually cleaned and reassembled for return to the user. The delay entailed by the need to remove and return the Compuvalve assembly for factory cleaning meant that either a vehicle was taken out of service or that the user was required to keep a working spare Compuvalve on hand to refit the vehicle for operation until the dirty valve had been cleaned and returned.

Attempts to solve this problem by employing better filters between the fuel supply and the regulator did not give satisfactory results. Despite the new and more expensive filters, contaminants still reached the solenoid valves and disabled the injectors.

What was needed was a procedure for cleaning fuel injectors that could be performed with the injector in situ by a vehicle owner or a local mechanic or technician that would put a vehicle quickly back in operation. The method and apparatus of the present invention provide the desired solution. While the foregoing summary and the following detailed description refer to the specific example of the cleaning of a GFI Control Systems Compuvalve injector, the method and device have more general applicability to the diagnosis of performance problems and the cleaning of other electronically operated or controlled fuel metering devices and systems, as will be apparent to those familiar with the construction and operation of such equipment.

BRIEF DESCRIPTION OF THE DRAWINGS

In the several figures of the drawings, in which like parts are indicated by like reference characters.

DETAILED DESCRIPTION OF PREFERRED EMBODIMENT

The cleaning apparatus and method according to the invention passes a controlled flow of cleaning liquid, preferably isopropyl alcohol, through the interior spaces within an electronically controlled gaseous fuel injector for removing deposited contaminants from the surfaces of internal cavities of the injector. In this description of a presently particularly preferred embodiment, the injector to be cleaned is a Compuvalve injector manufactured by the GFI Control Systems Inc. The apparatus and method of the invention enable the owner of a CNG powered vehicle or a local mechanic or technician to clean a dirty injector without removal of the injector or injector assembly from a vehicle in which the injector has been installed. The fuel inlet and outlet hoses are simply disconnected from the injector and replaced by inlet and outlet hoses for the cleaning solution, and an electrical cable that normally provides signal input to the internal control computer of the valve is replaced with a cable connecting the injector to an electrical cleaning control device, which can either comprise a console with switches for manual control of the opening and closing of solenoid valves of the injector or an external computer which can be programmed to open and close the solenoid valves in a chosen sequence.

Figure 1:
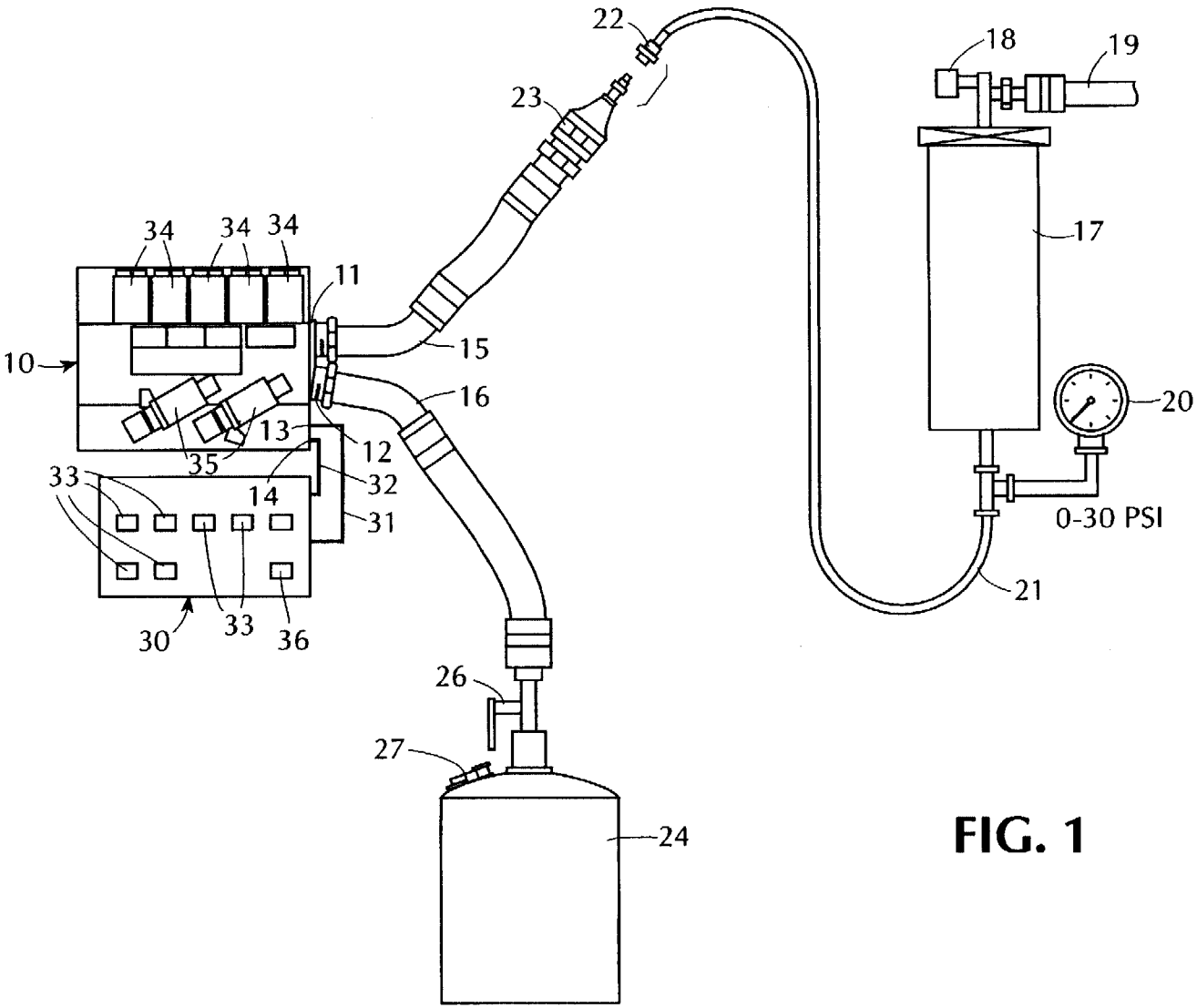
FIG. 1 is a simplified drawing of how a supply of cleaning liquid is connected to a Compuvalve injector for cleaning in accordance with the invention.

The overall arrangement of apparatus of the invention is illustrated in drawing FIG. 1 in which the reference numeral 10 generally designates an electronically controlled injector, shown as a Compuvalve injector.

The injector 10 has a fuel inlet port 11 which would in normal operation be connected to an inlet fuel hose for feeding CNG fuel from a regulator (not shown) to the injector 10 at a gauge pressure of approximately 100 pounds per square inch (100 psig). An outlet port 12 of the injector 10 would, under normal operating conditions, be connected to an outlet hose leading to the spray discharge unit or units located in the air intake of an engine. The fuel supply, regulator, inlet and outlet hoses, spray discharge unit, air intake and engine are not shown in the drawing since they are conventional equipment, and play no part in the operation of the apparatus or performance of the method of the invention.

The injector 10 is also shown as having signal port means at 13 for connection to an electrical cable for supplying an electrical signal which can control the operation of moving mechanical components of the injector 10, and another connecting means or tap at 14 through which a constant supply of low voltage electrical current can be drawn from the injector 10 if the vehicle ignition is turned on. The power input to the injector 10 and the numerous connections through which the inboard computer of the injector 10 is supplied with electrical signals representing temperature and pressure measurements taken by remote sensor devices, are not shown for simplicity of illustration, even though those electrical wires need not be disconnected from the injector 10, and ordinarily would not be disconnected, during the cleaning of the injector 10 in accordance with the invention.

A cleaning fluid inlet hose 15 and outlet hose 16 are shown connected to the inlet and outlet ports 11 and 12 respectively of the injector 10. A tank 17 containing a supply of clean isopropyl alcohol or other cleaning solution is shown connected through a pressure regulator generally designated 18 by a hose 19 which can be connected to any convenient supply of air under pressure, such as a compressor (not shown) or supply of shop air. A pressure gauge illustrated at 20 can be employed to assure that the isopropanol or other cleaning liquid is fed at substantially constant pressure to the injector 10 during cleaning. The regulator 18 is opened or closed to provide the desired pressure, as indicated by reading the gauge 20. It has been found that passing isopropyl alcohol through the interior passages and cavities of a Compuvalve injector 10 at a pressure of 30 psig or less will remove contaminant deposits from the interior of the injector 10 without the danger of damage to the Compuvalve injector 10.

The cleaning liquid tank 17 is shown as having an outlet hose 21 terminating in a connector 22 for connection to the open end of the inlet hose 15. A conventional adapter fitting, generally designated by reference numeral 23, is shown for accommodating any difference in the diameters of the supply tank outlet hose 21 and cleaning liquid inlet hose 15.

After passing through the injector and cleaning the internal components thereof, the isopropyl alcohol or other cleaning solution, carrying the contaminants removed from the injector, exits through the outlet port 12 and passes through the outlet hose 16 to a closed tank generally designated by reference numeral 24 for safe storage until the dirty liquid can be properly disposed of in accordance with any applicable waste disposal laws or regulations. The recovery tank 24 is shown equipped with a shut-off valve 26 and a pressure relief valve 27.

A switching console generally designated by reference numeral 30 is schematically illustrated in FIG. 1. Electrical cable 31 connects the console 30 to the signal port 13 of the Compuvalve injector 10, and DC power cable 32 connects the console 30 to the power output connector 14 of the Compuvalve injector 10 as schematically shown in FIG. 1. It will be understood that the console 30 could be battery powered or connected to some other low voltage direct current power supply if the injector to be cleaned does not provide an available or convenient power outlet.

The console 30 is shown as having a plurality of buttons 33 for manual opening and closing of switches. In the illustration of FIG. 1 there are eight buttons; one power on/off switch button 36, and one button 33 for each of the seven solenoid injector valves of the Compuvalve injector 10; but of course the number of buttons 33 and switches would differ depending upon the application for which the apparatus and method of the invention are to be employed. The buttons 33 and 36 could have internal light emitting diodes or other sources of illumination (not shown) to indicate whether the switches they control are in their on or off positions.

FIG. 1 also generally shows the Compuvalve injector 10 and the locations of the five (5) high flow injector valves 34 arranged side-by-side and upright, and the two (2) low flow injector valves 35 oriented at an angle to the vertical direction. The high flow injector valves 34 are strictly on/off devices which deliver the high fuel flows required for vehicle cruising and acceleration. Each of the high flow solenoid operated injector valves 34 has a maximum gas volume per unit time that differs from that of the other high flow injector valves 34, so that by the selective opening and closing of different valves 34 or subgroups of valves 34, the rate of gas flow delivered through the entire group of high flow injector valves 34 can be varied between a maximum when all of the high flow valves 34 are open to a minimum with all of the high flow valves 34 closed. The high flow injector valves thus control major changes in the flow rate of gaseous fuel to the engine. The low flow injector valves 35 are employed for idle and flow tuning gas flow. The low flow valves may be held open or pulsed as directed by the computer control. All of the injectors 34, 35 are of the peak and hold type.

Oil entrained by the CNG at the gas compressor, or other contaminants and debris can enter the injector 10 along with the pressurized natural gas despite the fact that there are filters interposed in the CNG supply line. The contaminant material will, over time, build up deposits on the surfaces of cavities and passages within the injector 10, and these deposits will impede the motion of the moving parts of the injector valves 34, 35, eventually causing a valve 34 or 35 to stick in an open or closed condition.

The deposits are primarily of organic materials, e.g., lubricating oil, and are therefore soluble in an organic solvent such as isopropyl alcohol, which is readily available and inexpensive as well as relatively easy to handle without posing any health or safety hazards in the ordinary garage or repair shop environment. It has been found that one pint (about 0.47 liters) of commercial isopropyl alcohol, when circulated through a Compuvalve injector will effectively remove deleterious contaminant deposits from within the Compuvalve injector and restore the injector to good working condition. Periodic flushing of an electronically operated and controlled injector such as the Compuvalve injector, when performed as part of a regular engine maintenance program, should prevent the build up of contaminant deposits from causing injector failure.

Figure 2:
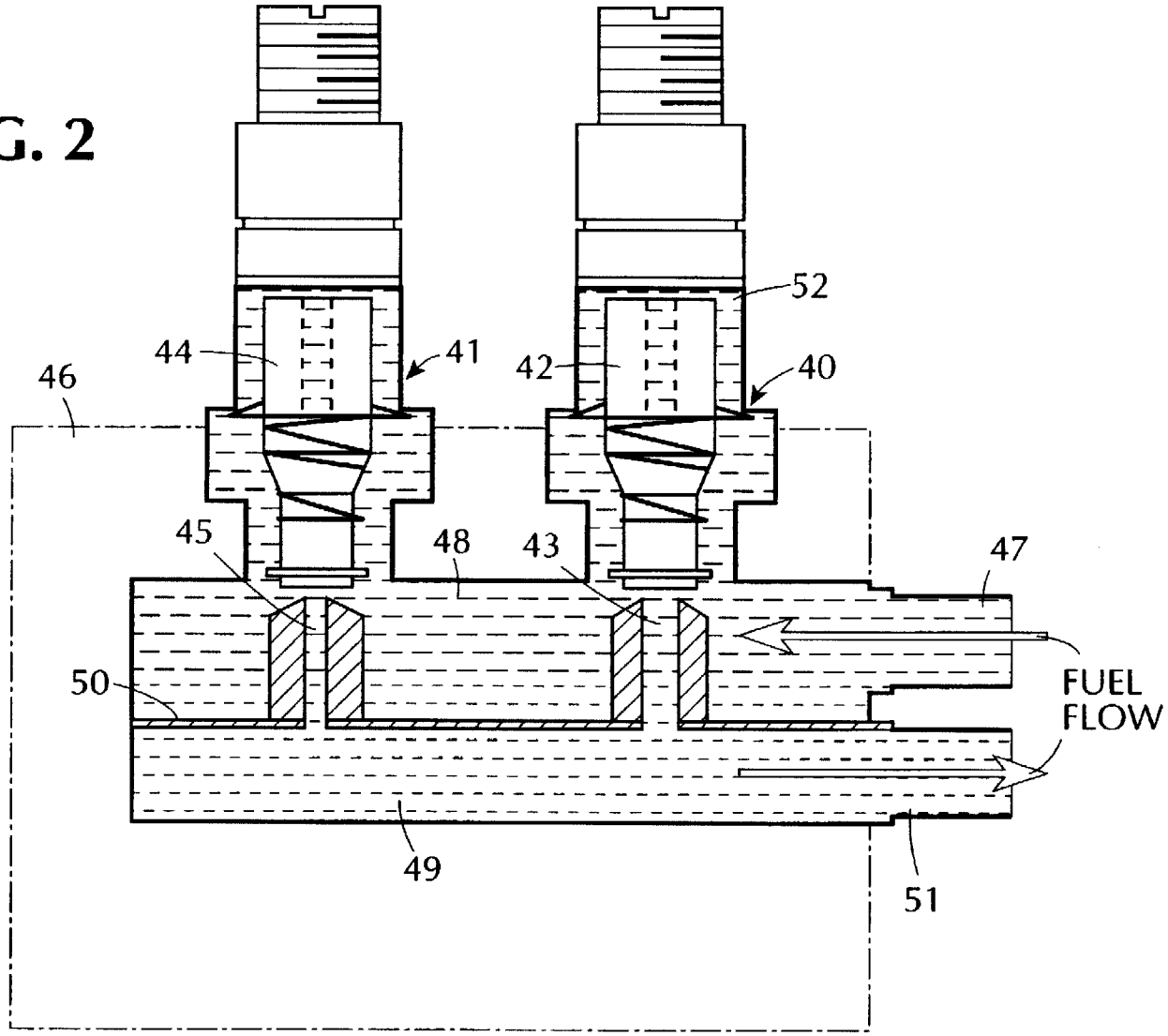
FIG. 2 is a diagrammatic illustration of the flow of gaseous fuel through a solenoid valve.

The flow path of gaseous fuel through an injector 10 such as the Compuvalve injector is illustrated in the simplified view of FIG. 2 in which two solenoid valves 40, 41 are shown to illustrate the open and closed valve positions. The valve 40 at the right hand side of FIG. 2 can be seen to have its valve body 42 in a downward position, closing the bore 43 through which gaseous fuel would otherwise flow, whereas the valve body 44 of the valve 41 is in a raised position, so that the bore 45 is open for the flow of gaseous fuel. It will be seen that the bore 43 is shown as being larger in diameter than the bore 45. The sizes of the bores 43 and 45 and the difference between the bore diameters is exaggerated in the simplified drawing of FIG. 2, which shows that the opening and closing of different valves of the group of valves of the injector (such as the five high flow valves 34 of the Compuvalve injector) can provide different fuel flow rates through the injector.

The valves 40 and 41 shown in the drawing can be taken to represent two of the five high flow solenoid valves 34 of a Compuvalve injector 10. An electrical coil (not illustrated in the drawing) is energized by a flow of electrical current to move the valve body 42 or 44 between open and closed positions. Details of the solenoid valve structure are not shown in the drawing of FIG. 2 because the particular valve construction does not affect the operation of the apparatus or performance of the method of the invention, which are intended to be suitable for use regardless of the structural details of the solenoid injector valves employed in the gaseous fuel injector 10.

Compressed natural gas fuel to the injector 10 via the inlet port 11 enters the valve block generally designated by reference numeral 46 in FIG. 2 through the inlet passage 47 and fills a plenum 48. When one or more of the injector valves represented by the valves 40 and 41 in FIG. 2 is open, the gaseous fuel can pass through a valve bore such as the bores 43 and 45 to an outlet chamber 49 separated from the plenum 48 by a wall 50, whence the CNG can pass through the passage 51 to and through the injector outlet port 12 to the engine.

Inspection of used solenoid valves of the type illustrated by the valve 40 has revealed that contaminant residues are deposited on the surfaces of the interior cavities and passages of the injector 10. In particular, it appears that contaminants entrained in the flow of CNG fuel, such as hydrocarbon lubricant materials, collect in the space behind the movable valve body, shown as a space or cavity 52 behind the valve body 42, even though the high flow solenoid injector valves 34 of Compuvalve injector 10 are mounted in a vertically upright position as shown in FIGS. 1 and 2. The contaminants leave residues on the interior surfaces of injector cavities such as the cavity 52 which interfere with the opening and closing of the valves 34 and 35.

In accordance with the present invention, isopropyl alcohol fed into the injector 10 follows the flow path ordinarily traversed by the gaseous fuel and accordingly contacts all of the surfaces upon which contaminants entrained in the gaseous fuel can be deposited. The isopropyl alcohol dissolves the organic components of the contaminant residues and the flow of cleaning liquid through the injector flushes the contaminants out of the injector 10.

The cleaning action of the cleaning liquid is facilitated by the opening and closing of the solenoid injector valves represented in FIG. 2 by the valves 40 and 41. The solenoid valves 34 and 35 of the injector 10 are opened and closed by feeding electrical signals emulating the operating signals which manually control the operation of the valves 34 and 35 to energizing coils of the respective valves 34 and 35 by opening and closing the switches controlled by the buttons 33 of the switching console 30. The isopropyl alcohol or other cleaning liquid flows through the injector 10 as the valves 34 and 35 are being opened and closed, cleaning the surfaces of interior injector cavities and passages and flushing contaminants out to the cleaning liquid recovery tank 24 via the outlet port 12 and outlet hose 16.

Figure 3:
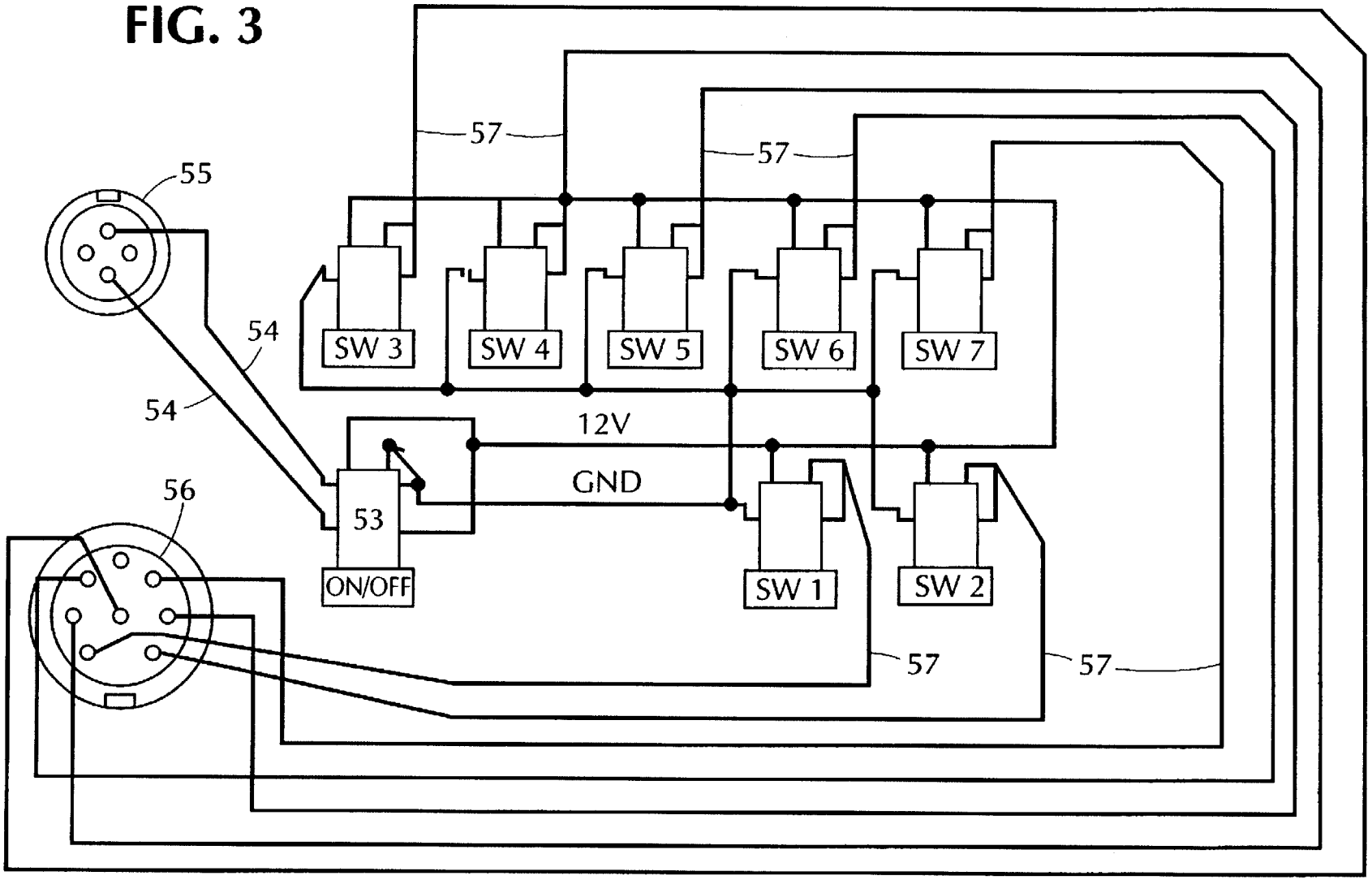
FIG. 3 is a wiring diagram illustrating the connections between an electrical switching console of the cleaning apparatus and a computer controlled injector.

FIG. 3 is a diagram showing a wiring arrangement for the switches SW1–SW7 operated by manually depressing the buttons 33 of the switching console 30. The power on/off switch 53 in FIG. 3 is operated by the on/off button shown at 36 in FIG. 1, which is similar to, but preferably spaced from the buttons 33 on the console 30.

In FIG. 3, two wires 54, corresponding to the power cable 32 of FIG. 1 are shown connecting the on/off switch 53 to a plug 55, shown as a four-pin plug for connection to the power tap or outlet 14 of the injector 10 in FIG. 1. The signal plug 56 is shown as an eight pin plug with seven pins for connecting the switches SW1–SW7 to the signal port 13 of the injector 10 as shown in FIG. 1. The seven wires 57 correspond to the signal cable 31 shown in FIG. 1. The plugs 55 and 56 are merely shown as an illustration of connectors suitable for use in connecting the console 30 of the preferred embodiment of the invention to a Compuvalve injector. The structure of the power and signal plugs employed can be chosen to support the particular power source and signal connection of the electronically controlled injector or other electronically controlled device with which the method and apparatus of the invention are to be used. These and other features, choices of materials and the like can be modified within the spirit and scope of the method and apparatus of the invention, which is particularly pointed out in the claims.

What is claimed:

1. A method for cleaning a gaseous fuel injector having a fuel inlet port, a fuel outlet port and at least one solenoid valve for metering gas flow by passing a cleaning liquid through the gaseous fuel injector, comprising: causing a cleaning liquid to flow through the gaseous fuel injector from said fuel inlet port to said fuel outlet port, supplying electrical current signals to the at least one solenoid valve to open and close the solenoid valve while cleaning liquid is flowing through the gaseous fuel injector and collecting the cleaning fluid at said fuel outlet port.

2. The method of claim 1 including causing cleaning liquid to flow through the injector by connecting the injector inlet port to a supply of cleaning liquid under pressure.

3. The method of claim 1, including recovering the cleaning liquid after the cleaning liquid has flowed through the injector by connecting said injector outlet port to a cleaning liquid recovery tank.

4. The method of claim 1, including supplying said electrical signal to the at least one solenoid valve by electrically connecting said solenoid valve to means providing a direct current signal and switching the direct current signal on and off to open and close said at least one solenoid valve.

5. A method for cleaning an electrically operated gaseous fuel injector having at least one fuel metering solenoid valve while said gaseous fuel injector is mounted in operating position in a compressed natural gas powered vehicle including causing a cleaning liquid to flow through the injector for cleaning internal cavities within the injector; supplying electrical direct current signals to said at least one fuel metering solenoid valve to open and close the at least one fuel metering solenoid valve while cleaning liquid is flowing through the at least one fuel metering solenoid valve when the at least one fuel metering solenoid valve is open; and collecting the cleaning fluid which flows through the at least one fuel metering solenoid valve.

6. The method of claim 5 including causing cleaning liquid to flow through the injector from a supply of cleaning liquid under pressure and recovering said cleaning liquid after the cleaning liquid has flowed through the injector.

7. The method of claim 5 including supplying said electrical direct current signals to said at least one fuel metering solenoid valve by connecting said at least one fuel metering solenoid valve to means providing an electrical direct current signal and switching the direct current signal on and off to open and close said at least one fuel metering solenoid valve.

8. A method of removing organic contaminant deposits from surfaces of interior cavities of an electronically operated gaseous fuel injector having a plurality of solenoid operated gas flow valves while the fuel injector is mounted in a compressed natural gas powered vehicle, said fuel injector having a fuel inlet port, a fuel outlet port, a signal port and a direct current power connector, comprising: feeding a cleaning liquid under pressure into said injector fuel inlet port, passing the cleaning liquid through said interior cavities to said fuel outlet port to remove said contaminant deposits and collecting said cleaning liquid through said fuel outlet port; leading electrical current from said power connector to a plurality of electrical on/off switches corresponding to the valves of said plurality of solenoid operated gas flow valves and connected to said signal port for opening and closing said plurality of solenoid operated gas flow valves, and selectively opening and closing said plurality of solenoid operated gas flow valves by turning said switches on and off.

9. The method of claim 8 including opening one of said plurality of solenoid operated gas flow valves at a time in succession to cause cleaning liquid to flow through each of said plurality of solenoid operated gas flow valves.

10. The method of claim 8 wherein the contaminant deposits comprise organic materials including using isopropyl alcohol as the cleaning liquid and allowing said cleaning liquid to remain in contact with said contaminant deposits for a period of time sufficient to substantially dissolve the organic materials.

* * * * *